US005755342A

United States Patent [19]

Hoffman

[11] Patent Number: 5,755,342

[45] Date of Patent: May 26, 1998

[54] COLLAPSIBLE GUN RACK

[76] Inventor: Donald W. Hoffman, 16326 E. Alabama Dr., Aurora, Colo. 80017-4156

[21] Appl. No.: 820,362

[22] Filed: Mar. 12, 1997

[51] Int. Cl.[6] ..... A47F 7/00

[52] U.S. Cl. ..... 211/64; 211/70.5; 211/204; 248/156

[58] Field of Search ..... 211/206, 204, 211/64, 70.5; 248/156, 166, 157, 423, 407, 96

[56] References Cited

U.S. PATENT DOCUMENTS

| | | | |
|---|---|---|---|
| D. 162,207 | 2/1951 | Mittenleiter | 211/64 X |
| D. 292,457 | 10/1987 | Hunter | D6/469 |
| D. 310,302 | 9/1990 | Southard | 211/64 X |
| D. 314,287 | 2/1991 | Albright, Sr. | D6/417 |
| D. 324,951 | 3/1992 | Narramore | D3/38 |
| D. 335,233 | 5/1993 | Long | D6/552 |
| D. 345,660 | 4/1994 | Mobley | D6/417 |
| D. 365,717 | 1/1996 | Cardenas | D6/552 |
| 1,620,199 | 3/1927 | Felicety | 211/204 |
| 2,251,271 | 8/1941 | Del Campo | 211/64 |
| 2,645,440 | 7/1953 | Heistand | 248/156 X |
| 2,793,764 | 5/1957 | Stork | 211/204 |
| 3,636,739 | 1/1972 | Smedley | 211/705 X |
| 3,746,177 | 7/1973 | Vilotti | 211/64 |
| 3,871,526 | 3/1975 | Mavsack | 248/156 X |
| 3,876,078 | 4/1975 | Gomes et al. | 211/64 |
| 3,952,878 | 4/1976 | Gorham | 211/64 |
| 4,089,423 | 5/1978 | Gorham et al. | 211/64 |
| 4,144,971 | 3/1979 | Balibrea | 211/64 |
| 4,181,221 | 1/1980 | Teunant | 211/64 X |
| 4,271,969 | 6/1981 | Gnesa | 211/64 |
| 5,370,240 | 12/1994 | Hand | 211/13 |
| 5,553,717 | 9/1996 | Minneman et al. | 248/156 X |

*Primary Examiner*—Robert W. Gibson, Jr.
*Attorney, Agent, or Firm*—Sheridan Ross, P.C.

[57] ABSTRACT

The present invention discloses a collapsible outdoor gun rack wherein in one configuration, that of a gun rack, a plurality of guns can vertically rest against the gun rack, and in a second collapsible or compact configuration the present invention is reduced in size and is easy to carry when, for example, trapshooting, target shooting and/or hunting.

5 Claims, 5 Drawing Sheets

COLLAPSIBLE GUN RACK

FIELD OF THE INVENTION

The present invention relates to a collapsible gun rack that, when assembled, supports a plurality of guns, and when collapsed provides a compact configuration that is easily carried.

BACKGROUND OF THE INVENTION

When outdoors, a hunter may desire to carry a gun rack for supporting guns when not being used. Portable gun racks that may be set up outdoors such as in a wilderness context have either not been able to provide support for a relatively large plurality of guns (e.g., 8 to 20), or such gun racks have not heretofore been transformable into a compact configuration that allows for carrying in, for example, a backpack. Accordingly, it would be advantageous to have an outdoor gun rack that supports a relatively large plurality of guns, such as is likely the case in trap shooting, target shooting and/or a hunting trip where a group of hunters are camping together, and additionally, where the gun rack is transformable into a compact, easily carried unit.

SUMMARY OF THE INVENTION

The present invention is an outdoor gun rack that is able to rack a relatively large plurality of guns and in addition, can be transformed into a compact configuration for ease of carrying. The gun rack includes a gun support having a gun supporting bar with cross members to provide slots or enclosures in which the barrel of a gun may be supported. Additionally, the gun rack includes two legs spaced apart and connected to the gun supporting bar wherein the legs provide ground support for the gun supporting bar. That is, each of the legs is foldably attached at one leg end to the gun supporting bar and the other leg end has a ground wedge allowing this latter leg end to be staked into the ground for maintaining the gun rack in an upright and stable position.

Moreover, it is a particularly important aspect of the present invention that the gun rack is transformable into a compact configuration for carrying by, for example, disassembling and/or folding various components of the gun rack. In particular, in one embodiment of the present invention, at least a portion of each leg is foldable so that it becomes adjacent to the gun supporting bar. Additionally, the legs themselves may be reduced in length from the length required to effectively support hunting rifles and shotguns. In particular, the legs of the gun rack of the present invention may have telescoping members that slide within one another, or the legs may be foldable, or the legs may have separable components wherein the legs may be disassembled from a fully functional gun rack to a compact and carryable configuration. Note that it is also an aspect of the present invention that when configured in its compact form, all the components of the gun rack are connected together for forming a unitary assembly so that no component of the gun rack can be easily accidentally lost or separated from the other components.

Other features and benefits of the present invention will become apparent from the detailed description with the accompanying figures contained hereinafter.

DETAILED DESCRIPTION OF A PREFERRED EMBODIMENT

Figure 1:
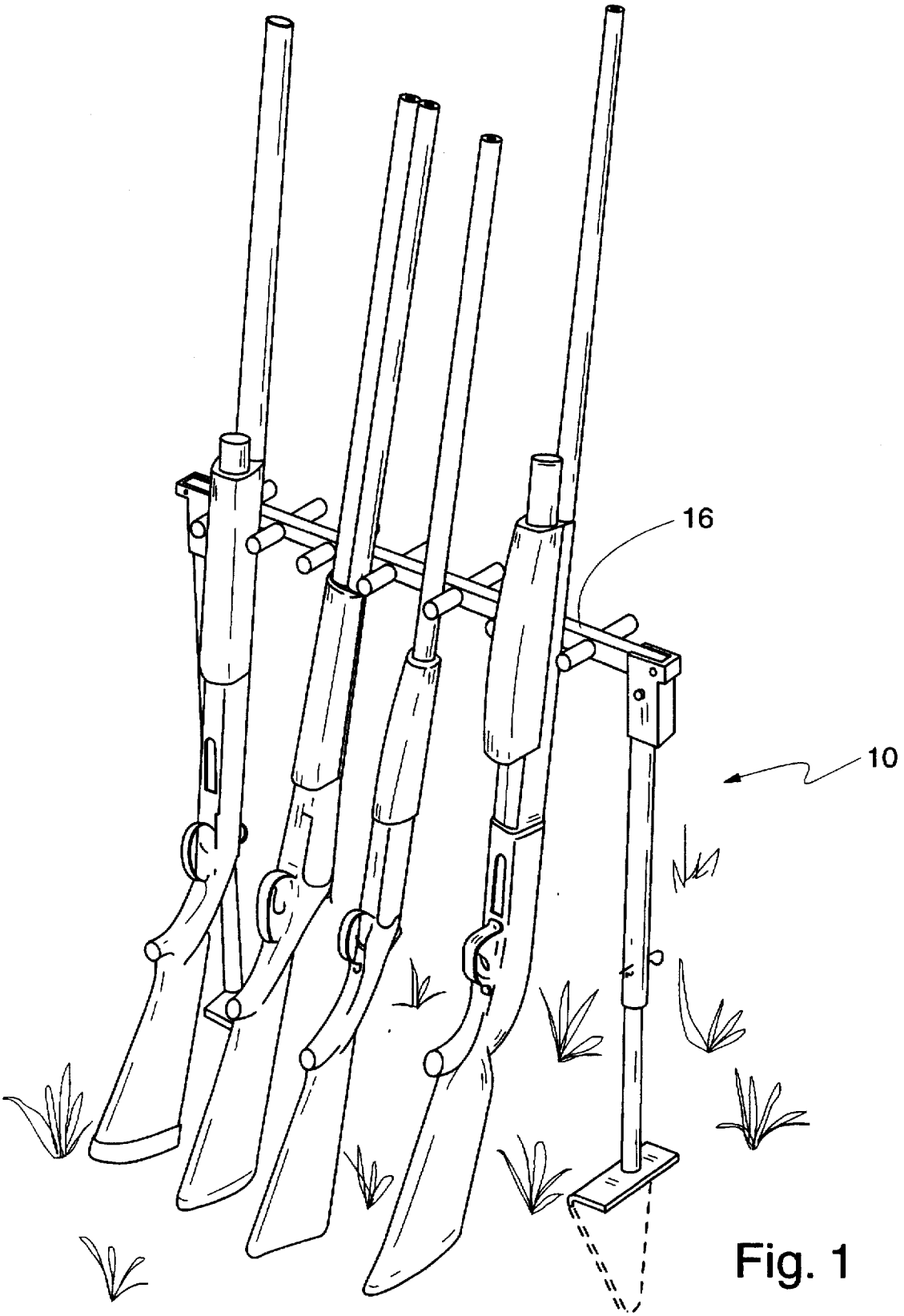
FIG. 1 illustrates the present invention assembled as a gun rack and supporting a plurality of guns in an outdoor setting.
Figure 2:
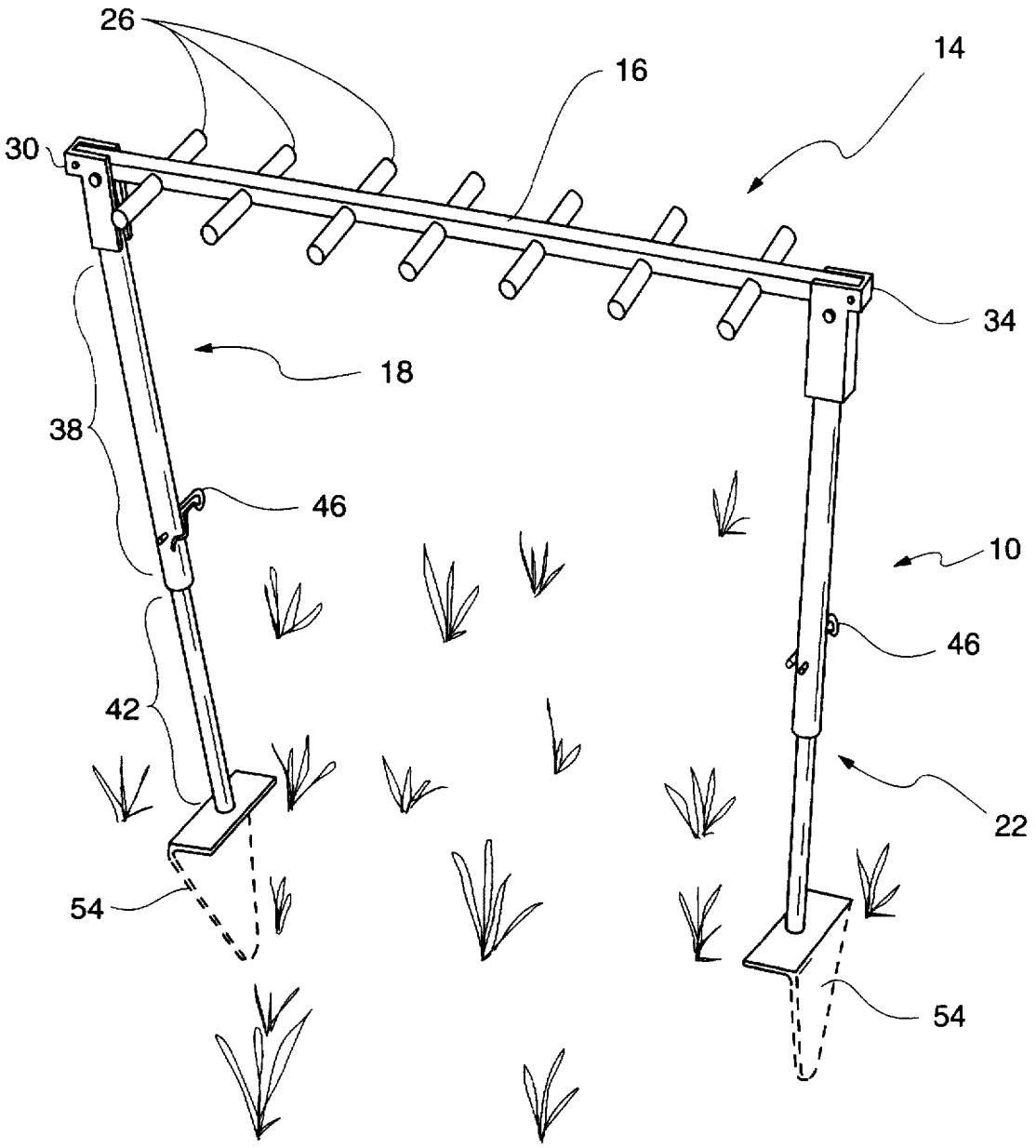
FIG. 2 illustrates the gun rack of the present invention wherein no guns are supported.

FIGS. 1 and 2 illustrate the gun rack 10 of the present invention fully assembled for support a plurality of guns. The gun rack 10 includes a gun support 14 having a gun supporting bar 16, which in the present configuration is substantially parallel to the ground, and has a longitudinal length running between first and second legs 18 and 22, respectively. Additionally, the gun support 14 includes cross-members 26 for assisting in conjunction with the gun supporting bar 16 in maintaining each of the guns supported by the gun rack 10 in a substantially vertical position as illustrated in FIG. 1. Each of the ends of the gun supporting bar 16 has a hinge for connecting this bar to one of the legs 18 and 22. In particular, hinge 30 connects the support bar to the leg 18 and hinge 34 connects the support bar to the leg 22.

Figure 3A:
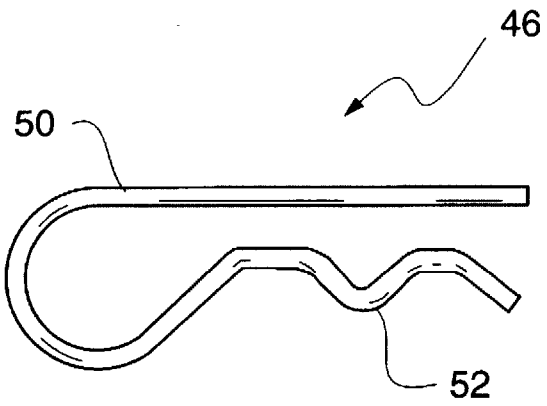
FIG. 3 illustrates the retaining pin 46 used to connect components of the gun rack of the present invention.
Figure 3B:
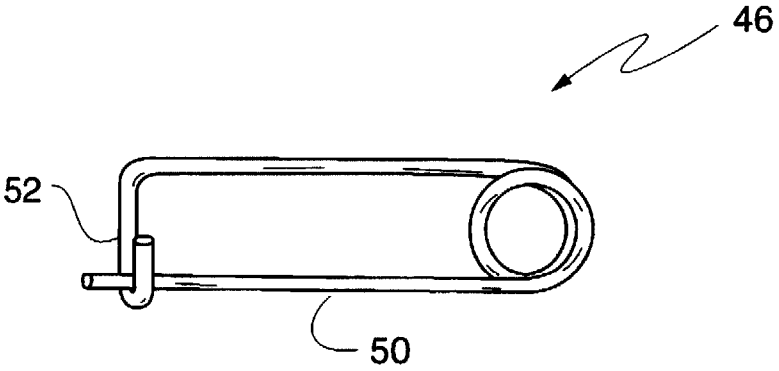

Referring now to the legs 18 and 22, these legs are substantially identical in their structure and functionality. Accordingly, since legs 18 and 22 have identical components, these components identical labeling on both legs. Thus, when the present invention is in a functional gun rack configuration, leg 18 (22) includes an upper leg portion 38 having one end of its length attached to hinge 30 (hinge 34 for attaching to leg 22) and the other end of its length connected to an end 32 of a lower leg portion 42. That is, the end 32, in one embodiment, is slidably fitted within upper leg portion 38, and the leg portions 38 and 42 are subsequently secured together by a retaining pin 46 (embodiments of which are shown in FIGS. 3A and 3B). That is, for each leg 18 and 22, there is a corresponding retaining pin 46 having a first pin portion 50 for fitting through aligned bores in the fitted ends of the upper and lower leg portions of the leg and additionally, each retaining pin also includes a securing member 52 for securing the first pin portion 50 in the aligned bores of the leg portions. Moreover, each lower leg portion 42 includes at an opposite end of its length from the end 32, a ground wedge 54 for securing the leg 18 (22) in the ground. Note that the wedge 54 includes a shoe support 58 for assisting a user in urging the point 62 of the wedge into the ground.

Figure 4:
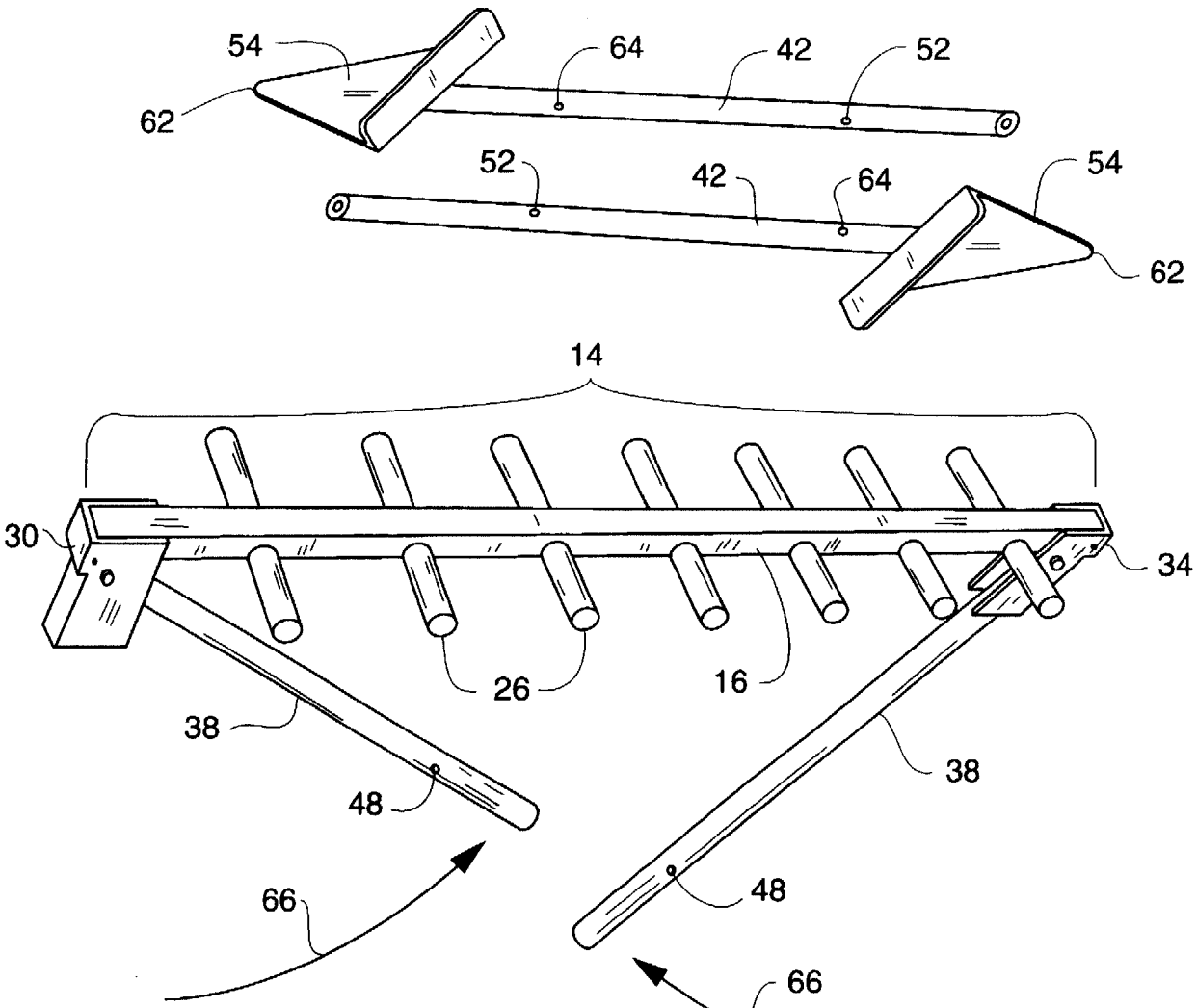
FIG. 4 illustrates the components of the present invention in a disassembled form.
Figure 5:
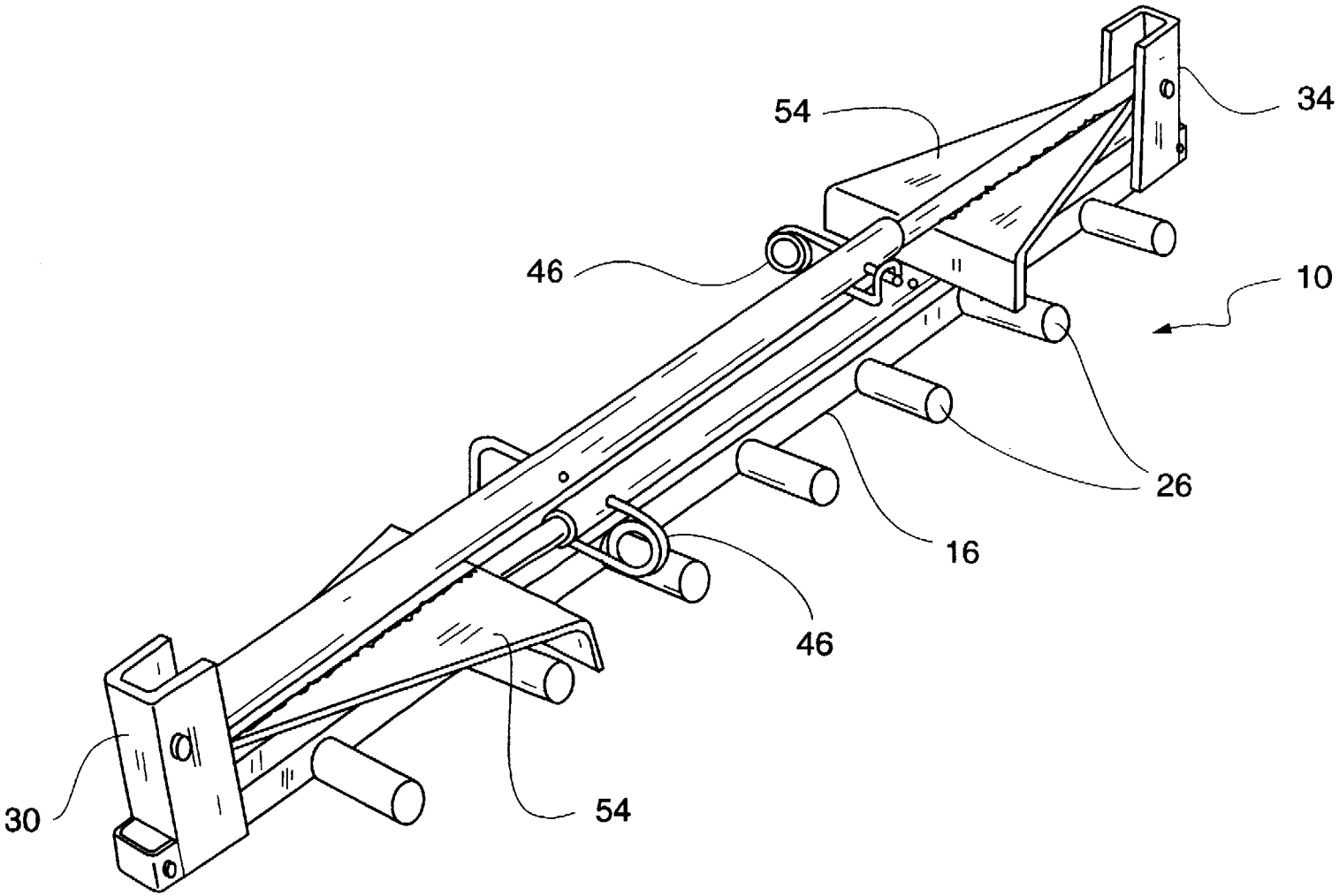
FIG. 5 illustrates the present invention in the compact configuration used for carrying the gen rack of the present invention.

Referring now to FIGS. 4 and 5, these figures illustrate the gun rack 10 of the present invention in a disassembled form (FIG. 4) and a compact configuration (FIG. 5) for ease of carrying when, e.g., hiking. Accordingly, as shown in FIG. 4, the lower leg portions 42 may be detached from the upper leg portions 38 and the upper leg portions may be folded adjacent to the gun supporting bar 16 in the direction of arrows 66. Thus, the compact portable configuration of FIG. 5 is obtained by such folding as well as positioning the lower leg portions 42 so that their lengths are also parallel to the gun supporting bar 16. Accordingly, by securing the lower leg portions 42 in any one of a number of ways to the folded assembly having the gun support 14 and the upper legs, the present invention may be easily carried by hunters on camping trips. In particular, the lower leg portions 42 may be secured to the folded assembly by sliding substantially the entire bar portion of the lower leg 42 into its corresponding upper leg portion 38 and affixing the two leg portions together with one of the retaining pins 46. That is, the retaining pin first portion 50 goes through the same bore of the upper leg portion 38 that is used for securing the leg portions together when the present invention is configured as a gun rack. However, in the compact configuration (FIG. 5), the first pin portion 50 extends through a second bore in the lower leg portion bar which is near the wedge 54, thereby securing a substantial portion of the length of lower leg portion 42 within the upper leg portion 38. Additionally, by providing the hinges 30 and 34 with, for example, a tension clamp spring or other such means for maintaining the upper arms in their folded position, the gun rack 10 of the present invention can be maintained in the compact configuration of FIG. 5 without additional cords or straps.

Note that alternative embodiments of the gun rack 10 are also within the scope of the present invention. In particular, the corresponding upper leg portion 38 and lower leg portion 42 of the leg 18 and/or of the leg 22 may be fixably and slidably connected together so that the lower leg telescopes within the corresponding upper leg portion between a retracted position and an extended position but does not separate from the upper leg portion. Alternatively, in another embodiment, the retaining pin 46 may be replaced by a hinge for folding the lower leg portion against the corresponding upper leg portion to which it is attached. Additionally, in another embodiment, the corresponding upper and lower leg portions may be threaded together when configuring the present invention as a gun rack. Moreover, the threading may be in addition to folding or telescoping of the upper and corresponding lower leg portions.

The foregoing description of the invention has been presented for purposes of illustration and description. Further, the description is not intended to limit the invention to the form disclosed herein. Consequently, variation and modification commensurate with the above teachings, within the skill and knowledge in the relevant art, are within the scope of the present invention. The embodiment described hereinabove is further intended to explain the best mode presently known of practicing the invention and to enable others skilled in the art to utilize the invention as such, or in other embodiments, and with various modifications required by their particular application or uses of the invention. It is intended that the appended claims be construed to include alternate embodiments to the extent permitted by the prior art.

What is claimed is:

1. A gun rack, comprising:

a gun support upon which each of a plurality of guns rests in a substantially vertical orientation, said gun support having a length;

at least one cross-member projecting transversely away from the length of the gun support; and first and second legs for positioning the gun support above an adjacent portion of the ground, said first and second legs each having a length between the gun support and the ground, said first and second legs spaced apart along the length of the gun support;

a first foldable connection operatively attached to the first leg and the gun support for folding the first leg and the gun support together so that the length of the gun support becomes adjacent to the length of the first leg when the gun rack is in a folded configuration.

2. A gun rack as claimed in claim 1, wherein at least one of the guns rests against the cross-member.

3. A gun rack as claimed in claim 1, wherein there is a plurality of the cross-members spaced apart along the length of the gun support.

4. A gun rack, comprising:

a gun support upon which each of a plurality of guns rests in a substantially vertical orientation, said gun support having a length;

first and second legs for positioning the gun support above an adjacent portion of the ground, said first and second legs each having a length between the gun support and the ground, said first and second legs spaced apart along the length of the gun support, said first leg including a means for changing the length of said first leg said means for changing includes telescoping leg portions of the first leg, wherein in an extended configuration, the leg portions provide the length of the first leg, and in a retracted configuration, reduce the length of the first leg; and a first foldable connection operatively attached to the first leg and the gun support for folding the first leg and the gun support together so that the length of the gun support becomes adjacent to the length of the first leg when the gun rack is in a folded configuration.

5. A gun rack, comprising:

a gun support upon which each of a plurality of guns rests in a substantially vertical orientation, said gun support having a length;

first and second legs for positioning the gun support above an adjacent portion of the ground, said first and second legs each having a length between the gun support and the ground, said first and second legs spaced apart along the length of the gun support;

a first foldable connection operatively attached to the first leg and the gun support for folding the first leg and the gun support together so that the length of the gun support becomes adjacent to the length of the first leg when the gun rack is in a folded configuration;

wherein said first leg includes a means for changing the length of the first leg, said changing means including threading one leg portion of the first leg into a second leg portion of the first leg.

* * * * *